US006467742B1

(12) United States Patent
Pitcher

(10) Patent No.: US 6,467,742 B1
(45) Date of Patent: Oct. 22, 2002

(54) POSTER-GRIPPING EXTRUSION

(75) Inventor: David E Pitcher, Cambridge, MA (US)

(73) Assignee: Rose Displays, Salem, MA (US)

( * ) Notice: Subject to any disclaimer, the term of this patent is extended or adjusted under 35 U.S.C. 154(b) by 0 days.

(21) Appl. No.: 09/563,015

(22) Filed: Apr. 29, 2000

(51) Int. Cl.[7] ..... A47G 1/17; G09F 23/00

(52) U.S. Cl. ..... 248/205.3; 248/316.7; 40/656; 40/666

(58) Field of Search ..... 248/205.3, 316.7; 40/656, 666

(56) References Cited

U.S. PATENT DOCUMENTS

| | | | | | |
|---|---|---|---|---|---|
| 3,324,585 | A | * | 6/1967 | Frederickson | 40/658 |
| 3,350,045 | A | * | 10/1967 | Mayers | 248/205.3 |
| 3,354,564 | A | * | 11/1967 | Falcone et al. | 40/658 |
| 3,364,528 | A | * | 1/1968 | Fletcher | 24/67.1 |
| 3,797,795 | A | * | 3/1974 | Hemgren | 248/316.7 |
| 4,623,169 | A | * | 11/1986 | Hutten | 281/45 |
| 4,629,075 | A | * | 12/1986 | Hutten | 211/89.01 |
| 4,899,974 | A | * | 2/1990 | Wear et al. | 248/467 |
| 5,384,935 | A | * | 1/1995 | Maier-Hunke et al. | 24/67 R |
| 5,396,722 | A | * | 3/1995 | Ostrovsky | 40/796 |
| 5,718,402 | A | | 2/1998 | Hoffman et al. | |
| 5,863,019 | A | * | 1/1999 | Rose et al. | 248/205.3 |
| 6,018,850 | A | * | 2/2000 | Lorber | 24/67.9 |
| D424,120 | S | * | 5/2000 | Wear | D20/43 |

FOREIGN PATENT DOCUMENTS

DE 40 36 882 C1 11/1990

* cited by examiner

*Primary Examiner*—Anita King
(74) *Attorney, Agent, or Firm*—Don Halgren

(57) ABSTRACT

A poster gripping extrusion device for the close-in maintenance and rigid support of a flexible sheet of display material. The device includes an elongated planar base having a first or distal edge and a proximal or second edge defining a width of said base. A leg extends parallel to the base, the leg having a distal edge and a proximal edge, and only a single web or bridging portion extending between the second edge and the proximal edge of the leg to provide compactness to the device. A pivotable clamp extends from the distal edge of the leg, the clamp providing a first and a second line of contact between the clamp and the base to securely hold a sheet of material therebetween. The clamp has a distalmost edge which extends beyond the distalmost edge of the base portion of the device, to permit ease of manipulation of the device in "close-in" locations.

6 Claims, 2 Drawing Sheets

POSTER-GRIPPING EXTRUSION

BACKGROUND OF THE INVENTION

1. Field of the Invention

This invention relates to articulable plastic extrusions for gripping and securing posters or signs to be utilized in commercial and retail display arrangements.

2. Prior Art

Advertising and marketing are critical to the modem retailer. Such practice requires the display of signs and posters that are typically suspended from ceilings, held by brackets by a standing support, or attached to a shelf or comer edge. These signs and posters must be maintained straight and "readable" from a snug-holding support apparatus. These supports must be easy to use, inexpensive to manufacture, and not distract from the poster or sign being displayed.

Sign-holding devices are certainly well-known in the art. Many of these devices however are extremely limited in their capabilities and or use. U.S. Pat. No. 3,324,585 to Frederickson shows a biasable clip, which actually lances the poster that it supports. A biasable panel is disposed in front of the poster, but the poster may be damaged by the mere attempt to pull the biasable panel away from the poster. U.S. Pat. No. 3,354,564 to Falcone shows a further clip which is actually a marking device that carries a plate on its front side. This very thin clip is utilized to fit over the edge of a cup or a bottle, having a disk which acts as a marker on the distal end of one of its legs. An irregular clip is shown in U.S. Pat. No. 3,955,286 to Kapstad, which clip has a pair of angled tongues arranged to bias against a connecting member to permit the device to be engaged onto a wall of a basket or the like. A card holding clip, shown in U.S. Pat. No. 4,341,028 to Brown, has one side which is adaptable to be disposed about a vertical rod. A self-attachable clip, shown in U.S. Pat. No. 4,566,183 to Greenberger, has a forward lip which defines in cross-section, a generally J-shape to that clip. The clip has a rear portion which engages a particular channel groove as may be found of the edge of a shelf. U.S. Pat. No. 4,822,862 to Salbsky, senior., shows a clip for mounting price cards upon container edges. This clip has a pair of legs, each of which are arranged in a curvilinear fashion. The clip is arranged to fit on the top of a bowl.

U.S. Pat. No. 5,718,402 to Hoffinan et al, and commonly owned with the present application, shows a poster-gripping extrusion. The extrusion in this '402 patent is more complicated than necessary, may well not fit in desired locations and the manufacture of it utilizes extra material when such may not be needed. German Patent DE 40 36 882 C1 also discloses an articulable poster gripper which however fails to provide the accessibility, compactness and efficient features of the present invention.

It is an object of the present invention to provide an efficient and simple poster or sign-holding clip extrusion which is an improvement over the prior art.

It is yet a still further object of the present invention, to provide a poster-gripping extrusion which itself, through its simplicity, permits it to be gripped by a channel support, where deemed necessary, or be attached in a corner placement in an unobtrusive manner.

BRIEF SUMMARY OF THE INVENTION

The present invention comprises a simplified and improved, elongated, articulable clip of plastic as a poster gripping extrusion for permitting the proper holding of flexible sheets as posters or signs in diverse locations. Such an elongated extruded clip of plastic may be run in lengths of about 50 centimeters to about 250 centimeters or more in length.

The improved elongated extruded clip has a planar base, of width, "w". The extruded clip also has a leg of elongated planar configuration, arranged parallel to the planar base, and attached unitarily thereto only by a transversely disposed bridging portion extruded therebetween to provide compactness and attachability in tight areas with minimum structure.

The leg has a distalmost edge which extends longitudinally parallel to the bridging portion, and extending widthwise to a location about the midpoint of the width of the planar base. The distal edge of the leg includes a living hinge which runs therealong. The living hinge connects the first leg to an articulable clamp.

The articulable clamp, attached to the leg by the co-extruded living hinge therebetween, is movable with respect to the planar base, in an arc pivoted about the living hinge. The articulable clamp has a proximal portion of generally linear or planar configuration which mates with the living hinge thereadjacent. The proximal portion of the articulable clamp has a flange member extending generally perpendicular thereto. The flange member is co-extruded with the articulable clamp and is unitary therewith. The flange member has a distalmost end, which provides a line of contact between the flange and the planar base when the articulable clamp is in its "engaged" or touching relationship with the planar base.

The articulable clamp has a curvilinear portion extending from the proximal portion thereof. The curvilinear portion is of arcuate configuration, having a distalmost edge which extends beyond the distalmost edge of the planar base, by at least approximately 0.1 centimeter. The arcuate or curvilinear portion of the articulable clamp has a radius of curviture "R", the distalmost edge of which is spaced a perpendicular distance above the plane of the planar base by about approximately 0.1 centimeter. The arcuate portion of the articulable clamp includes an arc segment component which engages the planar base, when in the clamp is in contact therewith. Thus, a line or contact and a wider line of contact such as an arc segment of the articulated clamp, provide two parallel lines of pressure against a sign or poster placed between the flange and the articulable clamp in the planar base when the articulable clamp is in engaging juxtaposition against that planar base.

The distal extension of the articulable clamp beyond the distalmost edge of the planar base, along with the raised distal edge of that articulable clamp above the surface of the planar base permits ready manual engagement of that articulable clamp to permit a pivoting thereof about its living hinge to permit entry of or removal of a poster or sign from the planar base.

The single web comprising the bridge portion between the planar base and the first leg thus identifies a generally U-shaped configuration, which would permit a generally U-shaped channel to slip thereover for support of the extrusion and poster thereattached from a ceiling or the like. That U-shaped arrangement between the planar base and the leg thus minimizes material, permits enclosed support by a further channel, and effects an uncomplicated, compact appearance of an extruded gripping member in a manner not found or shown in the art. The bridging portion also permits the gripping device to snugly and inconspicuously mate within a comer without distracting from the poster or sign being displayed.

The invention thus comprises a poster gripping extrusion for the close-in maintenance and rigid support of a flexible sheet of display material, comprising: an elongated planar base having a first or distal edge and a proximal or second edge defining a width of the base; a leg extending parallel to the base, the leg having a distal edge and a proximal edge, and a single web or bridging portion extending between the second edge and the proximal edge of the leg; a pivotable clamp extending from the distal edge of the leg, the clamp providing a first and a second line of contact between the clamp and the base to securely hold a sheet of material therebetween wherein the clamp has a distalmost edge which extends beyond the distalmost edge of the base portion of the device, to permit ease of manipulation of the device in "close-in" locations. The pivotable clamp may have a curvilinear portion and a linear portion. The pivotable clamp has a flange extending perpendicular from the linear portion to provide the second line of contact with respect to the base. The edge of the pivotable clamp extends about .1 cm. beyond the distal edge of the base. The distal edge of the pivotable clamp extends about 0.1 cm. above the distal edge of the base. The pivotable clamp is attached to the leg by a living hinge extruded therebetween. The planar base has an adhesive thereon to permit the device to be adhered "close-in" to a corner position.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
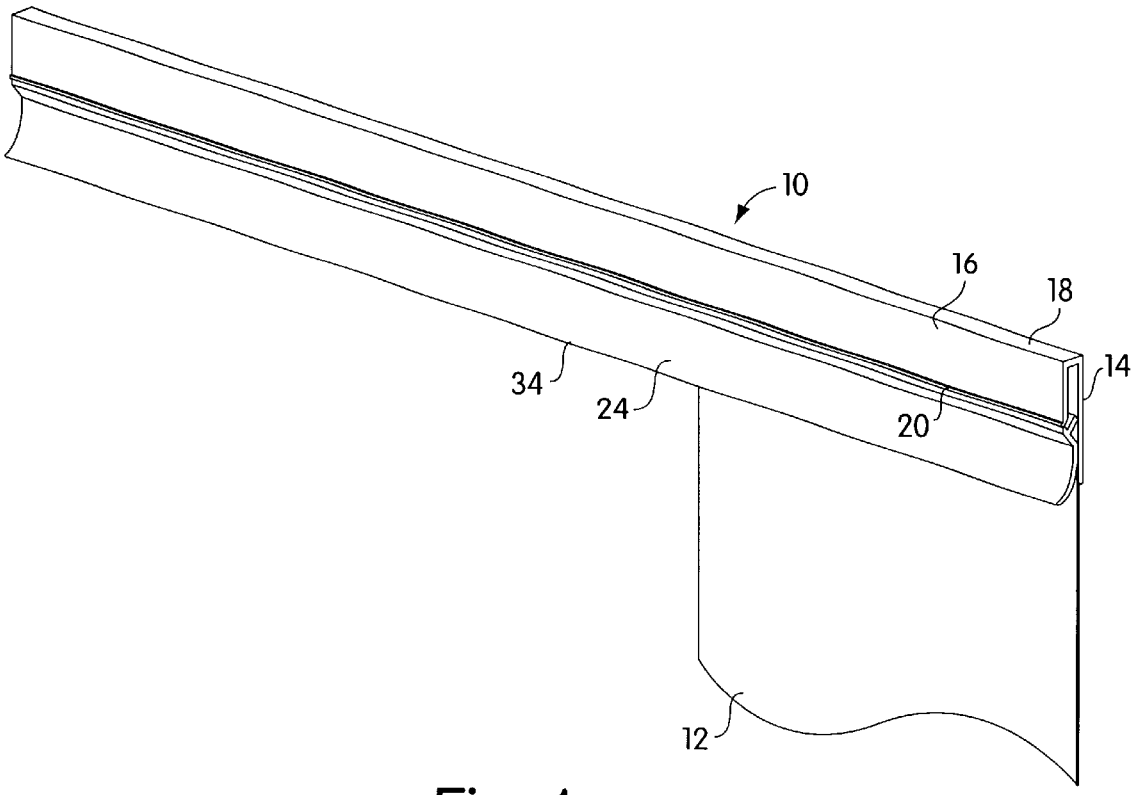
FIG. 1 is prspective view of a elongated poster-gripping extrusion constructed accorording to the principles of the present invention.

Referring now to the drawings in detail, and particularly to FIG. 1, there is shown the present invention which comprises a simplified and improved elongated, articulable poster gripping extrusion 10 for properly holding one or more sheets or posters or signs 12 in diverse commercially optimal locations.

The improved, elongated, extruded poster gripping clip 10 has a planar base 14, of width, "W". The extruded clip 10 also has a leg 16 of elongated planar configuration, arranged parallel to the planar base 14, and attached unitarily thereto by a transversely disposed bridging portion 18 extruded therebetween.

Figure 2:
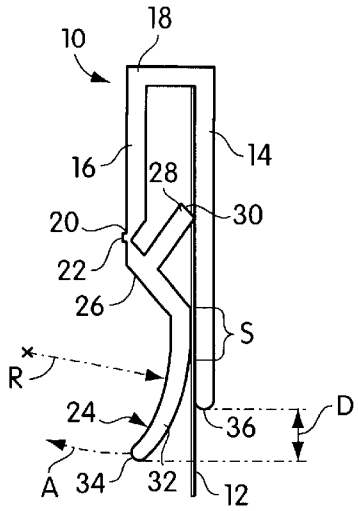
FIG. 2 is a side elevational view of the extrusion shown in figure one.
Figure 3:
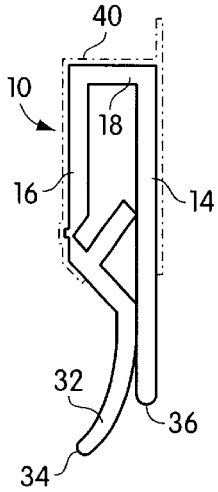
FIG. 3 is a side elevational view, similar to that shown in FIG. 2 with a further support arranged therearound.
Figure 4:
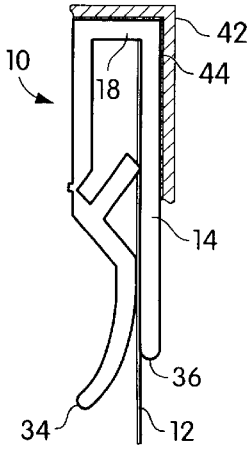
FIG. 4 is a side elevational view of a extruded gripping device of the present invention supporting a poster, the gripping device inconspicuously arranged against a comer.

The leg 16 has a distalmost edge 20 which extends longitudinally parallel to the bridging portion 18, and extending widthwise to a location about the midpoint of the width of the planar base 14, as may be seen in FIGS. 2, 3 and 4. The distal edge 20 of the leg 16 includes a living hinge 22 which runs therealong. The living hinge 22 pivotally connects the first leg 16 to an articulable clamp 24.

The articulable clamp 24, attached to the leg 16 by the co-extruded living hinge 22 therebetween, is pivotally movable with respect to the planar base 14, in an arc "A" pivoted about the living hinge 22, as represented in FIG. 2. The articulable clamp 24 has a proximal portion 26 of generally linear or planar configuration which mates with the living hinge 22 thereadjacent. The proximal portion 26 of the articulable clamp 24 has a flange member 28 extending generally perpendicular thereto. The flange member 28 is co-extruded with the articulable clamp 24 and is unitary therewith. The flange member 28 has a distalmost end 30, which provides a line of contact between the flange 28 and the planar base 14 when the articulable clamp 24 is in its "engaged" or pressure-touching relationship with the planar base 14.

The articulable clamp 24 has a curvilinear portion 32 extending distally from the proximal portion 26 thereof. The curvilinear portion 32 is of arcuate configuration, as may be seen in FIGS. 2–4, having a distalmost edge 34 which extends beyond the distalmost edge 36 of the planar base by at least approximately 0.1 centimeter. The arcuate or curvilinear portion 32 of the articulable clamp 24 has a radius of curviture "R", the distalmost edge 34 of which is spaced a perpendicular distance "D" above the plane of the planar base 14 by about approximately 0.1 centimeter. The arcuate portion 32 of the articulable clamp 24 includes an arc segment component "S" which engages the planar base 14, when in the clamp 24 is in contact therewith. Thus, a first line of contact and a wider line of contact such as an arc segment "S" of the articulated clamp 24, provide two parallel lines of pressure against a sign or poster 12 placed between the articulable clamp 24 and the planar base 14 when the articulable clamp 24 is in engaging juxtaposition against that planar base 14.

The distal extension 32 of the articulable clamp 24 beyond the distalmost edge 36 of the planar base 14, along with the raised distal edge of that articulable clamp 24 above the surface of the planar base 14 permits ready manual engagement of that articulable clamp 24 to permit a pivoting thereof about its living hinge 22 to permit insertion of or removal of a poster 12 or sign from the planar base 14.

The single web comprising the bridge portion 18 between the planar base 14 and the first leg 16 thus identifies a generally U-shaped configuration, which would permit a generally U-shaped channel 40, to slip thereover for support of the extrusion and poster thereattached from a ceiling or the like, as may be seen in FIG. 3. That critically important single web bridging member 18 completing the U-shaped arrangement between the planar base 14 and the leg 16 thus minimizes extruded plastic material, permits enclosed support by a further channel 40, and effects an uncomplicated appearance of an extruded gripping member in a manner not found or shown in the art. The critically important single web bridging portion 18 also permits the gripping device to snugly and inconspicuously mate "close-in" within a comer 42 by an adhesive 44 or the like, without distracting from the poster or sign being displayed, as may be best seen in FIG. 4.

I claim:

1. A poster gripping extrusion for close-in maintenance at a comer position and for rigid support of a flexible sheet of display material by said extrusion, comprising:

an elongated planar base having a first or distalmost edge and a proximal or second edge defining a width of said base;

a leg extending parallel to said base, said leg having a distal edge and a proximal edge, and a single web or bridging portion extending between said second edge and said proximal edge of said leg, said web and said planar base defining a close-in corner to permit said extrusion said close-in maintenance thereof; and a pivotable clamp extending from said distal edge of said leg, said clamp providing a first line of contact and a second line of contact between said clamp and said base to securely hold a sheet of display material therebetween wherein said clamp has a curvilinear portion and a linear portion and a distalmost edge which extends beyond said distalmost edge of said base of said extrusion, a flange extending perpendicular from said linear portion to provide said second line of contact with respect to said base to permit ease of manipulation of said extrusion in "close-in" locations.

2. The poster gripping extrusion as recited in claim 1, wherein said distalmost edge of said pivotable clamp extends about 0.1 cm. beyond said distalmost edge of said base.

3. The poster gripping extrusion as recited in claim 1, wherein said distalmost edge of said pivotable clamp extends about 0.1 cm. above said distalmost edge of said base.

4. The poster gripping extrusion as recited in claim 1, wherein said pivotable clamp is attached to said leg by a living hinge extruded therebetween.

5. The poster gripping extrusion as recited in claim 1, wherein said planar base has an adhesive thereon to permit said extrusion to be adhered close-in to a comer position.

6. A poster gripping extrusion the close-in maintenance at a corner position and for rigid support of a flexible sheet of display material by said extrusion, comprising:

an elongated planar base having a first or distalmost edge and a proximal or second edge defining a width of said base;

a leg extending parallel to said base, said leg having a distalmost edge and a proximal edge, and a single web or bridging portion extending between said second edge and said proximal edge of said leg, said web and said planar base defining a close-in corner to permit said extrusion said close-in maintenance thereof; a pivotable clamp extending from said distalmost edge of said leg, said clamp providing a first line of contact and a second line of contact between said clamp and said base to securely hold a sheet of display material therebetween wherein said clamp has a distalmost edge which extends beyond said distalmost edge of said planar base of said extrusion, to permit ease of manipulation of said extrusion in "close-in" locations, wherein said pivotable clamp has a curvilinear portion and a linear portion, said pivotable clamp also having a flange extending perpendicular from said linear portion to provide said second line of contact with respect to said base, said distalmost edge of said pivotable clamp extending about 0.1 cm. beyond said distalmost edge of said base and said distalmost edge of said pivotable clamp extending about 0.1 cm. above said distalmost edge of said base, and wherein said pivotable clamp is attached to said leg by a living hinge extruded therebetween.

* * * * *